US007922108B2

(12) United States Patent
Niemi et al.

(10) Patent No.: US 7,922,108 B2
(45) Date of Patent: Apr. 12, 2011

(54) METHOD FOR INDUSTRIAL PRODUCTION OF ESPECIALLY FINE POWDERS

(76) Inventors: Jouko Niemi, Pirkkala (FI); Jarkko Tamminen, Tampere (FI)

( * ) Notice: Subject to any disclaimer, the term of this patent is extended or adjusted under 35 U.S.C. 154(b) by 209 days.

(21) Appl. No.: 12/095,199

(22) PCT Filed: Nov. 20, 2006

(86) PCT No.: PCT/FI2006/000392

§ 371 (c)(1),
(2), (4) Date: May 28, 2008

(87) PCT Pub. No.: WO2007/060283

PCT Pub. Date: May 31, 2007

(65) Prior Publication Data

US 2008/0265068 A1 Oct. 30, 2008

(30) Foreign Application Priority Data

Nov. 28, 2005 (FI) ..... 20051212

(51) Int. Cl.
*B02C 19/06* (2006.01)

(52) U.S. Cl. ..... 241/5; 241/23; 241/39

(58) Field of Classification Search ..... 241/5, 39, 241/23

See application file for complete search history.

(56) References Cited

U.S. PATENT DOCUMENTS

| | | | | |
|---|---|---|---|---|
| 4,508,666 | A * | 4/1985 | Pietzarka et al. | 264/12 |
| 5,143,303 | A | 9/1992 | Niemi | |
| 5,598,979 | A * | 2/1997 | Rowley, Jr. | 241/5 |
| 5,695,132 | A * | 12/1997 | Gorzka et al. | 241/39 |
| 2003/0080224 | A1 * | 5/2003 | Rowley, Jr. | 241/5 |
| 2007/0075167 | A1 | 4/2007 | Niemi et al. | |

FOREIGN PATENT DOCUMENTS

| | | |
|---|---|---|
| DE | 19719445 | 11/1998 |
| FI | 112782 | 10/2003 |
| WO | WO 9836840 | 8/1998 |

* cited by examiner

*Primary Examiner* — Bena Miller
(74) *Attorney, Agent, or Firm* — Stites & Harbison PLLC; Douglas E. Jackson

(57) ABSTRACT

A method for industrial production of especially fine powders and mineral powders, where the material to be ground is mixed to a gas-solid matter suspension, which through acceleration nozzles (12) is led at least to two counter jets, which meet in grinding chamber (13) for further grinding of the powders. The ground gas-solid matter suspension is led in its turn by means of working gas at least to two intermediate containers (2*a*);(2*b*) in the grinding circulation, in which containers the gas is removed from the mixture and into intermediate container (2) a certain quantity of solid matter is collected, which quantity is returned to be ground and led to the other container (2) and the said quantity is circulated through the grinding process among intermediate containers (2*a*);(2*b*) until in some container the quality is established sufficient for removal off the process.

9 Claims, 3 Drawing Sheets

METHOD FOR INDUSTRIAL PRODUCTION OF ESPECIALLY FINE POWDERS

Figure 1:
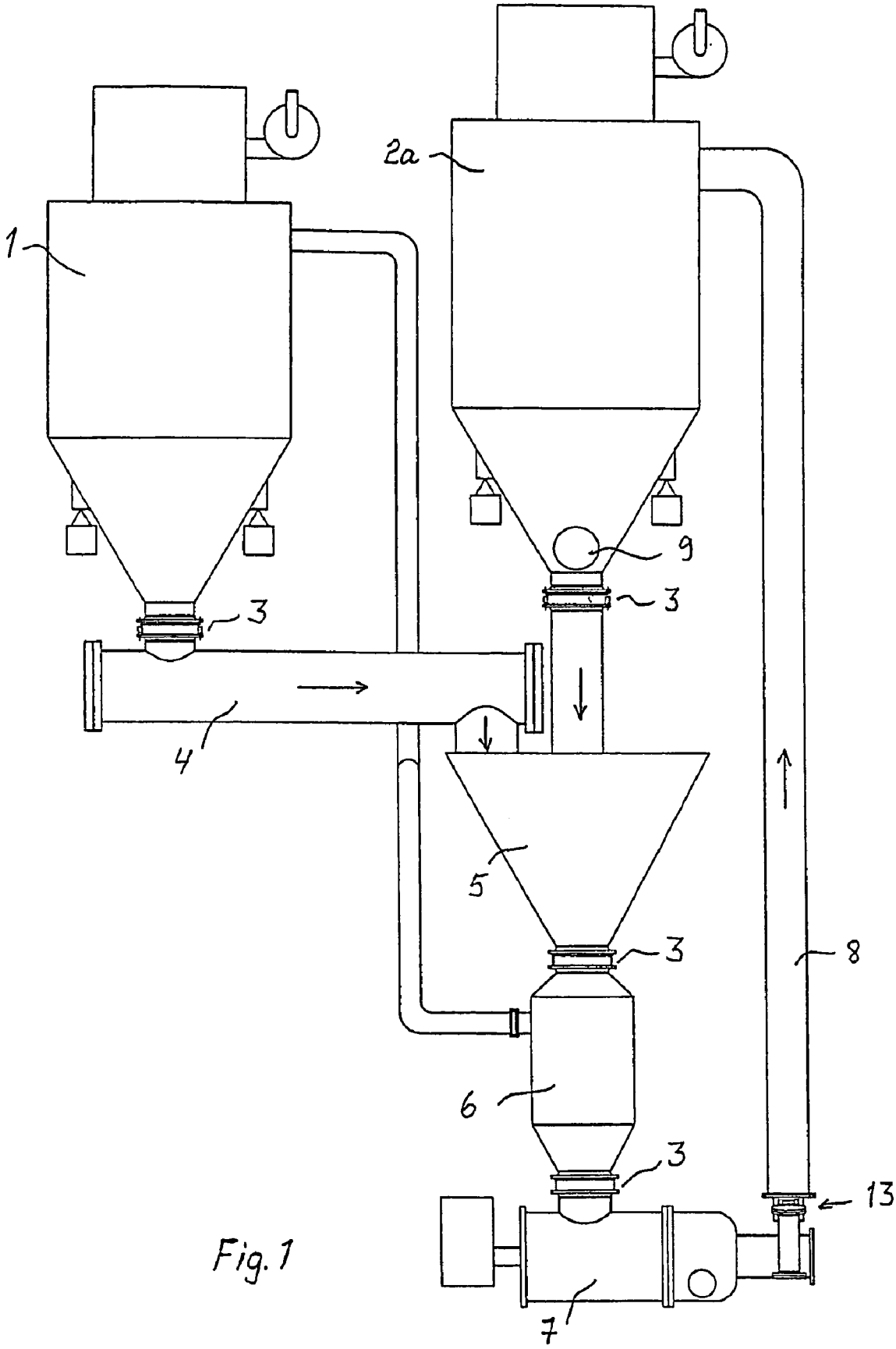

The above invention relates to a method for industrial production of extremely fine powders and mineral powders, where the material to be ground is mixed to a gas-solid matter suspension, which through acceleration nozzles is led at least to two counter jets, which meet in the grinding chamber for further grinding of the powders contained in the jets.

Currently there are in general use micronizing methods of different types based on 1-phase principle, by means of which dry fillers and coating matters and pigments, needed in the processing industry are produced. In devices based on 1-phase principle as grinding energy high pressure energetic working gas, compressed air and steam or some shielding gas is used.

As an essential part of a micronizing device working with 1-phase techniques is often also a pneumatic classifier, often furnished with a mechanical rotor. Processes functioning with 1-phase principle work so that the matter to be ground is fed to the process in the phase, where by means of mere and in separate gas nozzles accelerated high pressure, for instance 9 bar or even 16 bar working gas to corpuscle/particles kinetic energy is developed, as a result of which is that they get ground a little. Evidently the kinetic energy formed in the particles, in spite of the high pressure energetic working gas remains quite little and the grinding energy poor. It is especially difficult to produce with 1-phase techniques, in which especially particles are needed, the size of which on area 0.2-5 microns or the average grinding fineness is 0.2-5 microns, for instance from industrial paints. Then the energy consumption/cost rise quite heavily end the productive capacity of the equipment drops.

Matters to be ground can also contain several different type minerals, which differ remarkably from each other because of their physical properties and necessarily they must be separated from each other. In many embodiments separation technically and economically and qualitatively is reasonable to carry out before the grinding phase, since mixing of minerals of different properties is in all embodiments not desirable due to the wear-out problem that disturbs the end use or for instance problems connected to the colour of a ground end product. To prevent this phenomena is almost impossible in devices functioning with 1-phase principle, because in them it not possible to control and steer the energetic gas/solid matter suspension. This results in that if the separation is not made as a separate process before grinding, the quality of the end product will suffer and the energy consumption is high, because it is determined according to the mineral most difficult to grind.

The functioning conditions of the grinding method working with the 1-phase principle also gets worse, because while the size of particles becomes smaller, classification on using a rotor furnished with a pneumatic classifier, gets extremely difficult, since due to their small mass particles under 5 microns behave in flows almost as gas.

Devices working with 1-phase flow are often also built so that grinding and classification take place in the same space, and they are bound to each other also through the quantity of working gas. This is not good, because a small change in either part process may have a disturbing effect on the other part process. This kinds of limitations in present devised based on in 1-phase principle limit strongly the possibilities to produce dry end products to their average grinding fineness of 0.2-5.0 micron, needed by the industry, economically and effectively for the industry.

It has been possible to eliminate the above observed disadvantages a little with the 2-phase method according to patent publication FI-112782, where the grinding result, achieved with counter spray grinder, is led at least to one intermediate container in the grinding circle, where the gases removed from it are collected. From there it is returned to get ground together with new raw material, till there is in the grinding circle a circulating load aimed at, after which the process goes on, so that from it as much ready product is removed as much as raw material is added to it.

However, this solution does not give a good enough particle distribution in the end result. In other words, there is plenty of too small particles, and on the other hand there are plenty of them on the top limit permitted due to its size. In order to make the particle distribution more uniform as before for further improvement of the quality a new method is developed characterized in that the ground gas solid matter suspension is by means of working gas led in its turn at least to two intermediate containers in the grinding circulation, in which containers the gas is removed from the mixture and into the intermediate container a certain quantity of solid matter is collected, which quantity is returned to be ground and led to the other intermediate container and the said quantity is circulated through the grinding process among the intermediate containers until in some intermediate container the quality of grinding is stated sufficient for removal off the process.

The other characteristics of the invention are disclosed in the dependent claims.

The advantage of the invention is that when a grinding batch of certain degree is led always at a go to re-grinding without mixing new raw material into it, the process remains under control and it is possible, while the grinding cycles are advancing by of adjustment of the nozzles, to change the impact of the spray among different batches in a way wanted, for instance, depending on which grinding cycle is at work in the batch. There is always, in the stage of removal from the process, a homogeneous batch that has passed through a certain kind of grinding and into which in no phase any product of another kind has been mixed.

Figure 2:
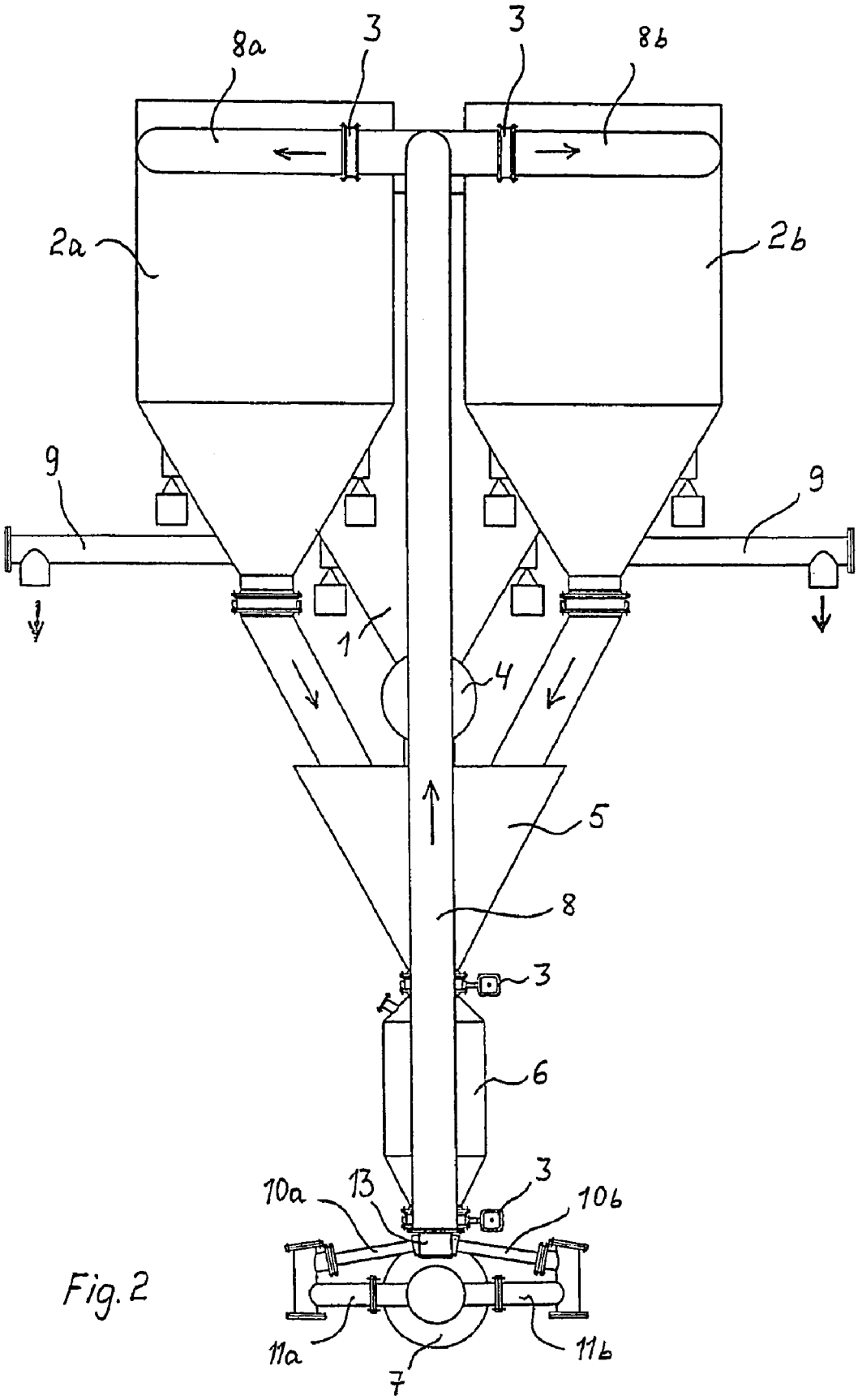
Figure 3:
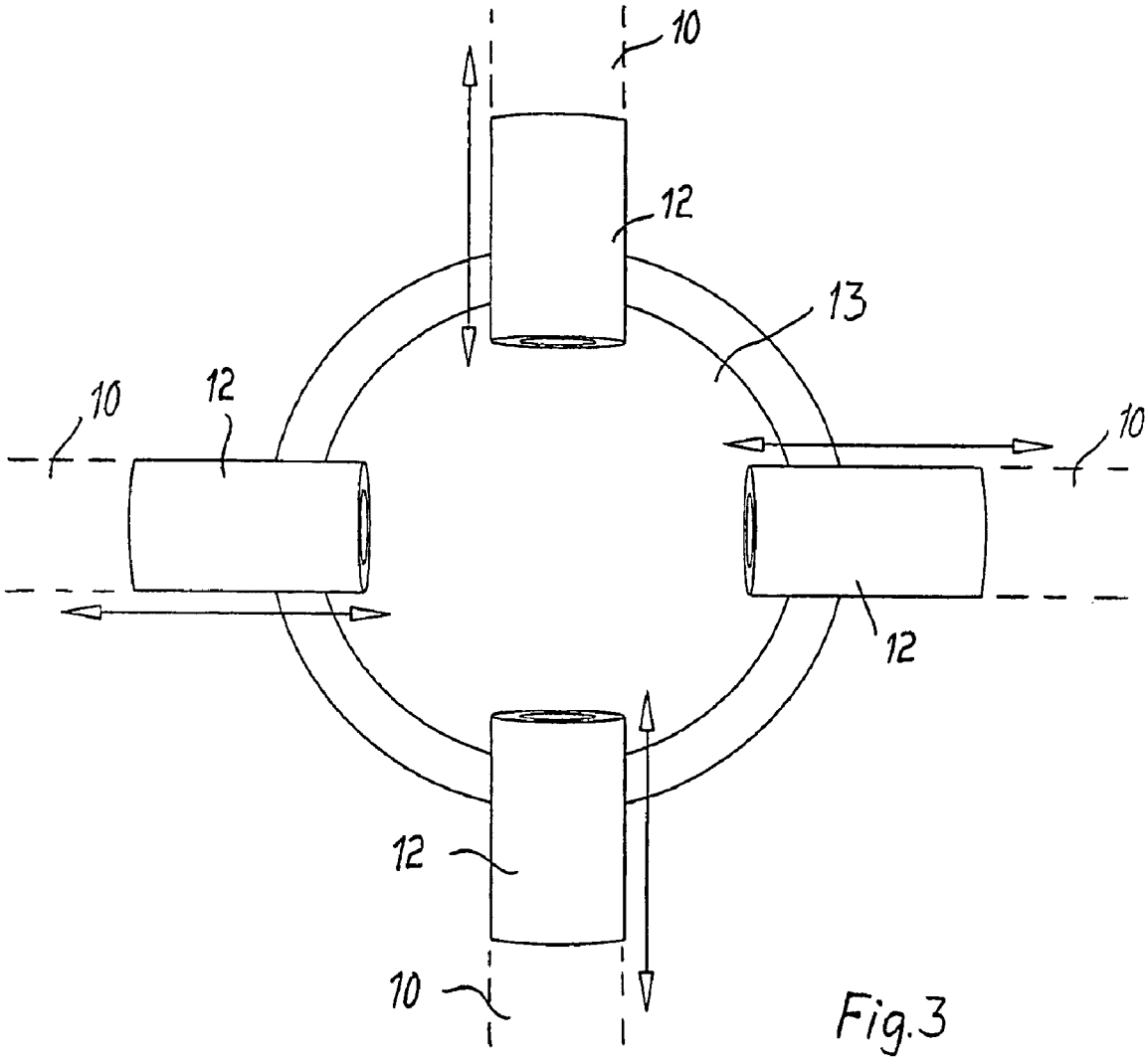

In the following the invention is disclosed with reference to the enclosed drawings, where FIG. 1 shows as an example a side view of the equipment used for carrying out the method according to the invention, FIG. 2 shows the equipment of FIG. 1 seen from the right side, FIG. 3 shows the grinding chamber, into which four nozzles are coming.

Material to be ground according to the invention, possibly pre-ground in an mechanical grinder, or for instance moist material, containing several minerals, is fed from feed container 1 through valve feeder 3 to feeding tunnel 5, out of which it is let down step-by-step to intermediate container 6 of the feeder arranged between two valves 3, into which it is possible to generate negative pressure by means of the blower in container 1. The pressure difference between container 5 and container 6, before upper valve 3 opens, remarkably accelerates the slow motion of material, as to its bulk density low, by grinding. After receipt of material valve 3 is closed and intermediate container 6 pressurized for instance to a 5 bar pressure, where after the lower valve 3 of double-valve feeder in container 6 is opened and the pressurized material batch is forced by means of overpressure into container 7, out off which it is led to the proper spray grinder 13 by means of working pressure and a possible screw conveyor when at first the lower valve 3 in container 6 has been closed. The pressure of intermediate container 6 is lowered in letting the pressure off to some other suitable part of the process. Material from intermediate container 6 is led to distribution reservoir 7 a batch at a time. The size of batch can be weighed.

From spray grinder 13 the suspension is led along tube 8 to the one of the intermediate containers 2*a* or 2*b*. When container 2*a* or 2*b* has this way been made full, emptying the container to feeder tunnel 5 begins and a batch at a time is fed through distribution reservoir 7 to the jet grinder and further again along tube 8 to the other waiting empty container 2*a*, 2*b*. The filling degree of container 2*a*, 2*b* can also be clarified in furnishing the container fit for weighing.

The quality of contents of the containers 2*a* and 2*b* is controlled in cycles. When a full container is established to fulfil the distribution degree determined for the particle size the suspension in the container 2*a*, 2*b* is emptied as ready-made product along tube 9 from the process.

FIG. 2 shows the side by side placed containers 2*a* and 2*b*. Counter spray grinder 13 is in the lower end of the tube 8 and the materials get to it from two directions along tubes 10*a* and 10*b*.

The number of grinding cycles depends on the required final result. Other parameters are also available, as adjustment of the mass flow of solid matter in relation to the working gas mass flow. On grinding also the temperature of the working gas, pressure and the quantity of energy fed into it can be changed during the grinding cycles and in the same way the corresponding values of working gas led to nozzles 12 can be modified.

FIG. 3 shows a counter spray grinder, which has four nozzles 12. One important way of saving is to adjust the number of nozzles 12 of counter spray grinder 13 and the distance between them. With the adjustments it is possible to influence the quantity of necessary kinetic energy and the distribution of particles that generates. For the distance of nozzles 2 always an optimum distance can be found in all cases, with the numbers of nozzles and different mass flows and different working pressures and, of course, depending even on the mineral qualities to be ground.

The invention claimed is:

1. A method for industrial production of especially fine powders and mineral powders, where the material to be ground is mixed to a gas-solid matter suspension, which through acceleration nozzles is led at least to two counter jets, which meet in grinding chamber for further grinding of the powders contained in the jets, wherein the ground gas-solid matter suspension is led in its turn, by means of a working gas through at least to two intermediate containers in the grinding circulation, in the at least two intermediate containers, the gas is removed from the mixture, and wherein into a first one of the two intermediate containers, a certain quantity of solid matter is collected, which quantity is returned to be ground and led to a second one of the at least two intermediate containers and said quantity is circulated through the grinding process among the at least two intermediate containers until in some container the quality is established sufficient for removal off the process.

2. The method according to claim 1, wherein mass flow of solid matter to be led into the grinding chamber is among the grinding adjusted as different.

3. The method according to claim 1, wherein the temperature, pressure of the batch to be circulated and the quantity of energy fed into it are measured.

4. The method according to claim 1, wherein the mutual distance of nozzles included in the counter spray grinder is adjusted in order to optimize the distribution of the particles and the use of energy.

5. The method according to claim 1, wherein the number of grinding cycles is determined according to the starting particle size of the powder and the grinding energy fed into the process.

6. The method according to claim 1, wherein the primary input of material to be ground is interrupted for the time of the grinding cycles and started when the removal of the ground material from container begins.

7. The method according to claim 1, wherein different grinding cycles have one or more operating parameters selected from the group consisting of a different working gas temperature, a different pressure and a different number of nozzles used.

8. The method according to claim 1, wherein the size of the batch of material to be led into at least one of the at least two intermediate containers is checked by weighing.

9. The method according to claim 1, wherein compressed air is used as working gas of grinding.

* * * * *